US007897876B2

(12) United States Patent
Tsotsis et al.

(10) Patent No.: US 7,897,876 B2
(45) Date of Patent: Mar. 1, 2011

(54) CARBON-NANOTUBE/GRAPHENE-PLATELET-ENHANCED, HIGH-CONDUCTIVITY WIRE

(75) Inventors: Thomas K. Tsotsis, Orange, CA (US); Nicholas A. Kotov, Ypsilanti, MI (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 12/756,603

(22) Filed: Apr. 8, 2010

(65) Prior Publication Data

US 2011/0024158 A1 Feb. 3, 2011

Related U.S. Application Data

(63) Continuation-in-part of application No. 12/348,623, filed on Jan. 5, 2009.

(51) Int. Cl.
*H01B 5/00* (2006.01)

(52) U.S. Cl. ..... 174/126.1; 174/126.2

(58) Field of Classification Search ..... 174/35 MS, 174/36, 102 R, 104, 106 R, 102 A, 116, 113 C, 174/126.1, 126.2
See application file for complete search history.

(56) References Cited

U.S. PATENT DOCUMENTS 6,846,985 B2 * 1/2005 Wang et al. ..... 174/391
6,864,418 B2 * 3/2005 Wang et al. ..... 174/391
6,980,865 B1 * 12/2005 Wang et al. ..... 607/121
6,988,925 B2 1/2006 Arthur et al.
7,118,693 B2 10/2006 Glatkowski et al.
7,378,040 B2 5/2008 Luo et al.
2004/0129447 A1 * 7/2004 Beeli et al. ..... 174/125.1
2008/0286560 A1 11/2008 Huang et al.
2009/0035469 A1 2/2009 Sue et al.
2010/0170694 A1 7/2010 Tsotsis
2010/0170695 A1 7/2010 Tsotsis

FOREIGN PATENT DOCUMENTS

WO 2005119772 A2 12/2005
WO 2007024206 A2 3/2007
WO 2008076473 A2 6/2008

OTHER PUBLICATIONS

Palumbo, M. et al; Layer-by-Layer Thin Films of Carbon Nanotubes; Material Research Society; 2006; pp. 0901-Ra05-41-Rb05-41.1 to 0901-Ra05-41-Rb05-41.6; vol. 901E, Jan. 2006.
Loh, K. et al.; Multifunctional Layer-by-Layer Carbon Nanotube-Polyelectrolyte Thin Films for Strain and Corrosion Sensing; Smart Materials and Structures; 2007; pp. 429 to 439; vol. 16, Feb. 2007.
Sandler, J. et al.; Carbon-Nanofibre-filled Thermoplastic Composites; Materials Research Society; 2002; pp. 105 to 110; Vo. 706.

(Continued)

*Primary Examiner*—William H Mayo, III
(74) *Attorney, Agent, or Firm*—Armstrong Teasdale LLP

(57) ABSTRACT

A conductive wire includes an aramid fiber and at least one layer attached about the aramid fiber, the at least one layer including at least one of aligned carbon nanotubes and graphene platelets.

19 Claims, 7 Drawing Sheets

OTHER PUBLICATIONS

Zhao, Y. et al.; The Growth of Layer-by-Layer Aligned Carbon Nanotubes; IEEE; 2006; pp. 253 to 254, Jan. 2006.
Mamedov, A. et al.; Molecular Design of Strong Single-Wall Carbon Nanotube/Polyelectrolyte Multilayer Composites; Nature Materials; Nov. 2002; pp. 190 to 194; vol. 1; Nature Publishing Group, Dec. 2002.
U.S. Appl. No. 12/348,595, filed Jan. 5, 2009.
U.S. Appl. No. 12/348,623, filed Jan. 5, 2009.

* cited by examiner

CARBON-NANOTUBE/GRAPHENE-PLATELET-ENHANCED, HIGH-CONDUCTIVITY WIRE

CROSS REFERENCE TO RELATED APPLICATIONS

This application is a continuation-in-part application of U.S. patent application Ser. No. 12/348,623 which was filed on Jan. 5, 2009 and titled "THERMOPLASTIC-BASED, CARBON NANOTUBE-ENHANCED, HIGH-CONDUCTIVITY WIRE", the contents of which is incorporated by reference in its entirety.

STATEMENT REGARDING FEDERALLY SPONSORED RESEARCH & DEVELOPMENT

This invention was made with United States Government support under ATP/NIST Contract 70NANB7H7043 awarded by NIST. The United States Government has certain rights in the invention.

BACKGROUND

The field relates generally to fabrication of conductors, and more specifically to conductors that incorporate carbon nanotubes (CNTs) and the methods for fabricating such conductors.

Utilization of CNTs in conductors has been attempted. However, the incorporation of carbon nanotubes (CNTs) into polymers at high enough concentrations to achieve the desired conductivity typically increases viscosities of the compound containing the nanotubes to very high levels. The result of such a high viscosity is that conductor fabrication is difficult. A typical example of a high concentration is one percent, by weight, of CNTs mixed with a polymer.

Currently, there are no fully developed processes for fabricating wires based on carbon nanotubes, but co-extrusion of CNTs within thermoplastics is being contemplated, either by pre-mixing the CNTs into the thermoplastic or by coating thermoplastic particles with CNTs prior to extrusion. Application of CNTs to films has been shown, but not to wires.

Utilization of CNTs with thermosets has also been shown. However, thermosets are crosslinked and cannot be melted at an elevated temperature. Finally, previous methods for dispersion of CNTs onto films have not focused on metallic CNTs in order to maximize current-carrying capability or high conductivity.

The above-mentioned proposed methods for fabricating wires that incorporate CNTs will encounter large viscosities, due to the large volume of CNTs compared to the overall volume of CNTs and the polymer into which the CNTs are dispersed. Another issue with such a method is insufficient alignment of the CNTs. Finally, the proposed methods will not produce the desired high concentration of CNTs.

BRIEF DESCRIPTION

In one aspect, a conductor wire is provided. The conductor includes an aramid fiber and at least one layer attached about the aramid fiber. The at least one layer includes at least one of aligned carbon nanotubes and graphene platelets.

In another aspect, a method for fabricating a conductive wire is provided. The method includes aligning at least one of carbon nanotubes and graphene platelets dispersed within a solution, partially dissolving an aramid fiber through chemical treatment, passing the treated aramid fiber through the solution such that a portion of the at least one of carbon nanotubes and graphene platelets aligned and dispersed within the solution adheres to the treated aramid fiber, and washing and drying the fiber.

In still another aspect, a method for fabricating a conductor is provided. The method includes partially dissolving an aramid fiber through chemical treatment and adhering at least one of aligned carbon nanotubes and aligned graphene platelets to the partially dissolved aramid fiber.

DETAILED DESCRIPTION

The described embodiments seek to overcome the limitations of the prior art by placing high volume fractions of carbon nanotubes (CNTs) and/or graphene platelets onto the surface of a lightweight substrate to produce high-conductivity wires. One embodiment uses a continuous process and avoids the processing difficulties associated with dispersion of CNTs within the polymer (or other matrix resin) that may unacceptably raise viscosity of the mixture and make the materials unprocessable before fabrication of the conductor. One result of the described embodiments is a continuous, low-cost method for producing high-conductivity electrical wires containing a high concentration of metallic CNTs, graphene platelets, or a combination of the two, using layer-by-layer (LBL) application.

Figure 1:
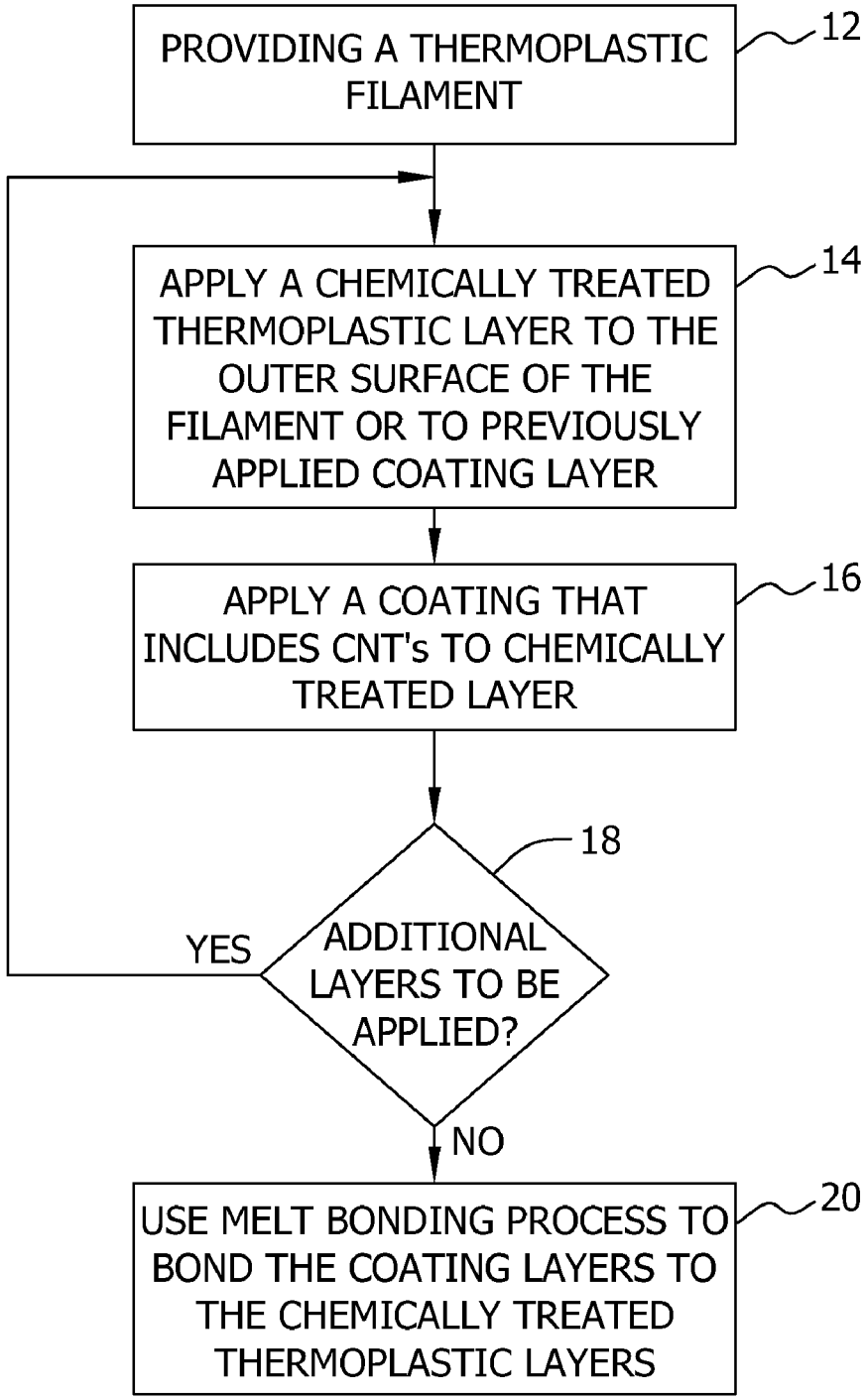
FIG. 1 is a flowchart illustrating conductor fabrication that incorporates carbon nanotubes.

One embodiment, illustrated by the flowchart 10 of FIG. 1, includes a method for producing high-conductivity electrical wires based on layer-by-layer coating methodologies and metallic carbon nanotubes (CNTs) to introduce sufficiently high concentrations of CNTs into polymeric materials resulting in a high-conductivity conductor. The focus is on high conductivity combined with high flexibility for electrical conductors instead of focus on high stiffness, high strength, or modest increases in conductivity as were prior layer-by-layer applications.

Now referring to the flowchart 10, a thermoplastic filament, sometimes referred to herein as a substrate, is provided 12. In one embodiment, a sulfonated thermoplastic layer is applied 14 to the outer surface of the thermoplastic filament. A coating, including CNTs, is then applied 16 to the sulfonated thermoplastic layer. Several alternating layers of sulfonated thermoplastic and the coating may be applied 18 to the thermoplastic filament. The assembly is then melt-processed 20 to form CNT-enhanced, high-conductivity thermoplastic conductor. The melt-processing 20 step bonds the coating to the individual thermoplastic layers. After melt-bonding, an outer coating, such as wire insulation, can be applied to the layered assembly.

The process illustrated by the flowchart 10 allows for high volume fractions of aligned carbon nanotubes to be applied to the surface of a thermoplastic to produce high-conductivity wires using a layer-by-layer process. Such a process avoids the necessity for having to mix nanoparticles and/or nanotubes into a matrix resin, since the combination of the two may result in a compound having an unacceptably high viscosity. Continuing, the high viscosity may make processing of the resulting compound difficult.

Figure 2:
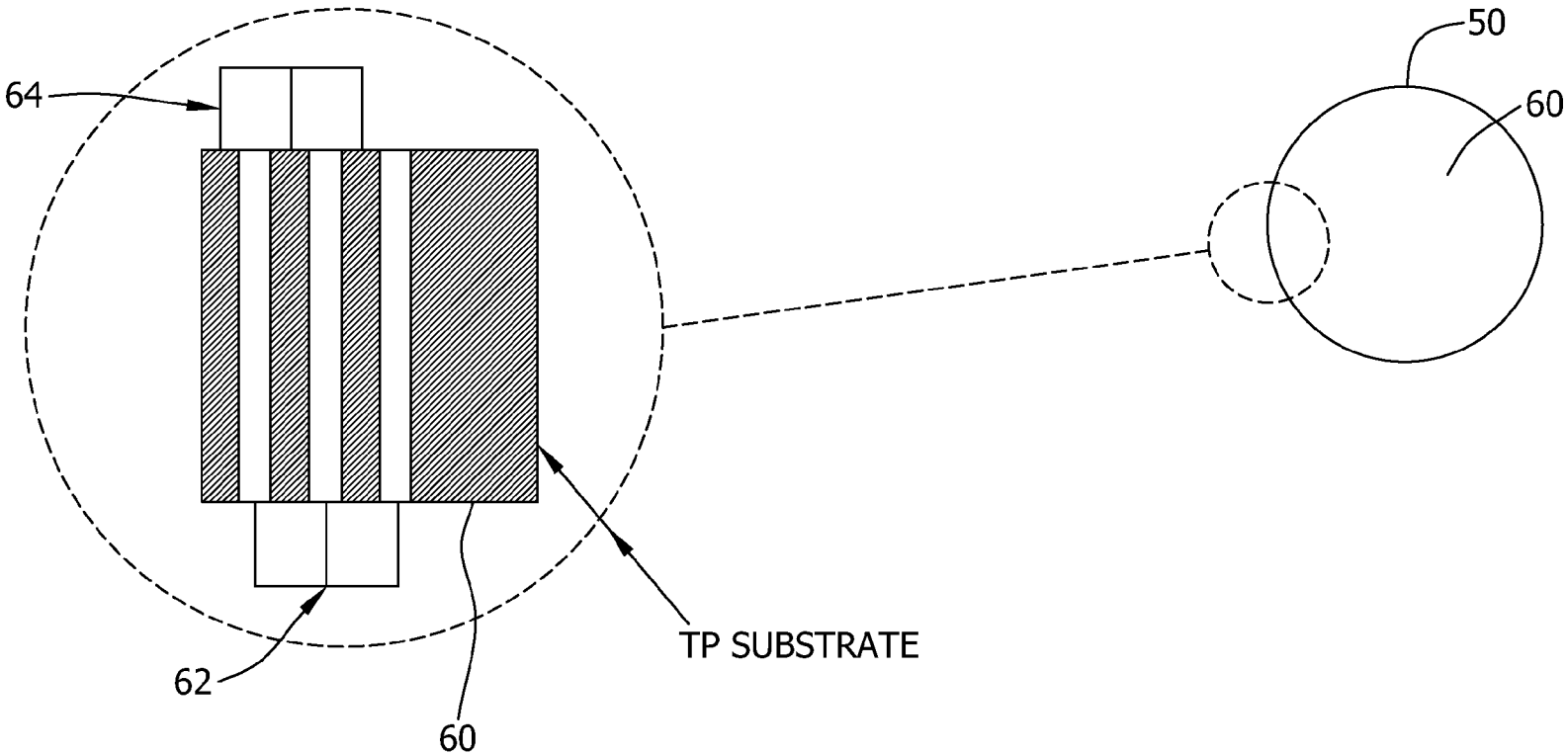
FIG. 2 is a cross-sectional diagram further illustrating a conductor 50 fabricated utilizing the process of FIG. 1.

FIG. 2 includes a cross-sectional diagram further illustrating a conductor 50 fabricated utilizing the process of FIG. 1. As shown in the cross section of conductor 50, the thermoplastic filament 60, or substrate, has a plurality of alternating sulfonated thermoplastic layers 62 and layers 64 that include CNTs therein. The layers 62 and 64 are placed around the circumference of thermoplastic filament 60. In one specific embodiment, the layers 64 that include the CNTs are processed to include only single-walled nanotubes. While filament 60 is illustrated as being circular in cross-section, the embodiments described herein are operable with any cross-sectional configuration for the filament.

Generalizing beyond sulfonization, in layer-by-layer fabrication, layers are applied from solutions generally having different charges. As such, the substrates are chemically prepared for layer-by-layer deposition by appropriately treating the surface, of which sulfonization is one example.

Figure 3:
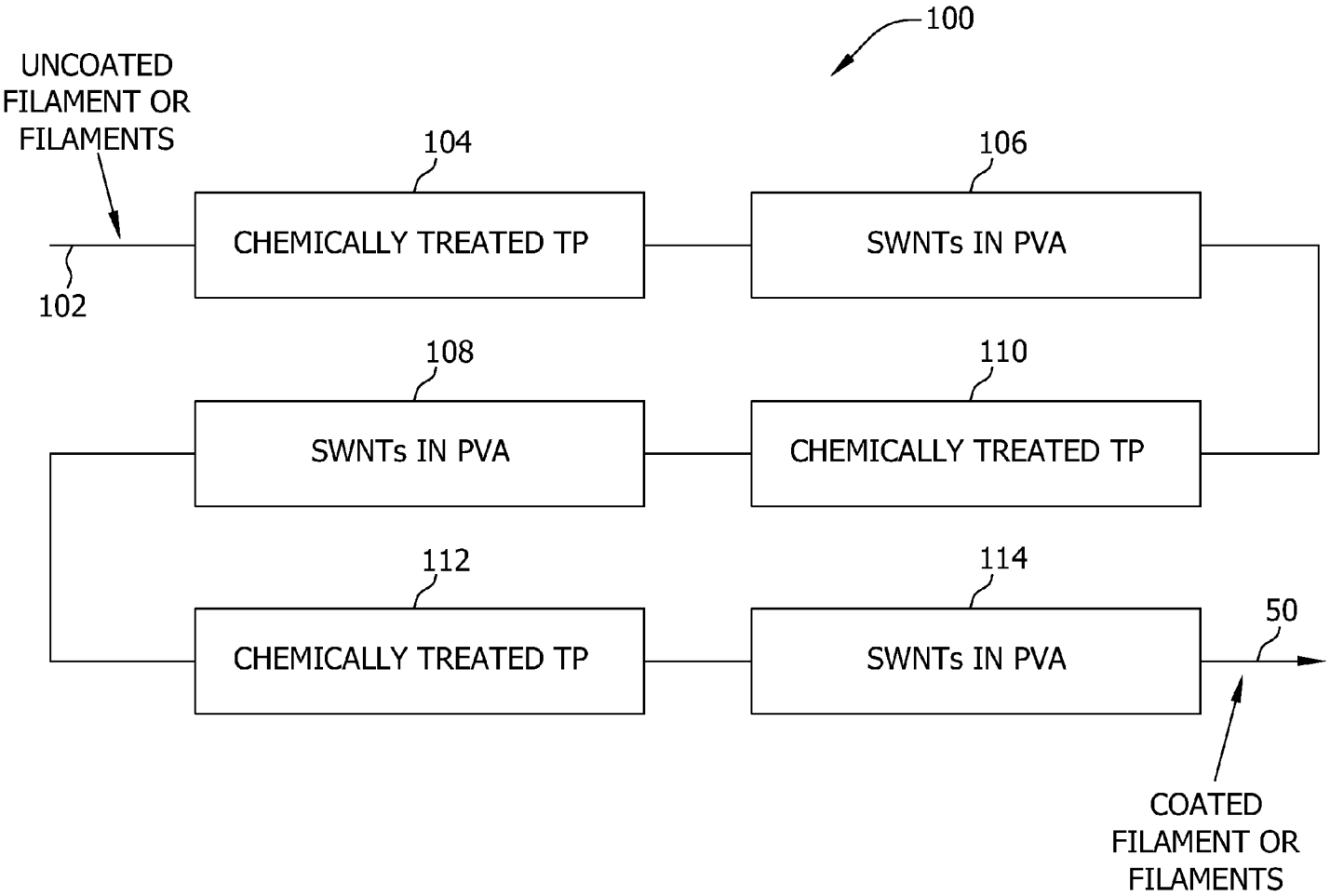
FIG. 3 is a flow diagram illustrating one mode of application of alternating layers of thermoplastics and carbon nanotubes to fabricate the conductor illustrated in FIG. 2

The illustrated embodiment shown in FIG. 2 includes three thermoplastic layers 62 alternating with three CNT embedded layers 64. FIG. 3 is a flow diagram 100 the further illustrates the process for fabricating a conductor with the three alternating layers 62, 64. It should be noted that the three-layer configuration is but one example of a conductor, and that fewer or additional alternating layers could be utilized depending on, for example, expense and desired conductivity. Now referring specifically to FIG. 3, one or more uncoated filaments 102 are coated 104 with a sulfonated thermoplastic in preparation for application of the CNTs. The CNTs are applied 106, for example, by passing the thermoplastic coated filaments through a polyvinyl alcohol solution which includes the CNTs. To build up the conductor to the three-layer embodiment, the filaments 102 are alternatively coated 108, 112 with the sulfonated thermoplastic and CNTs are applied 110, 114 resulting in the conductor 50 illustrated in FIG. 2.

Figure 4:
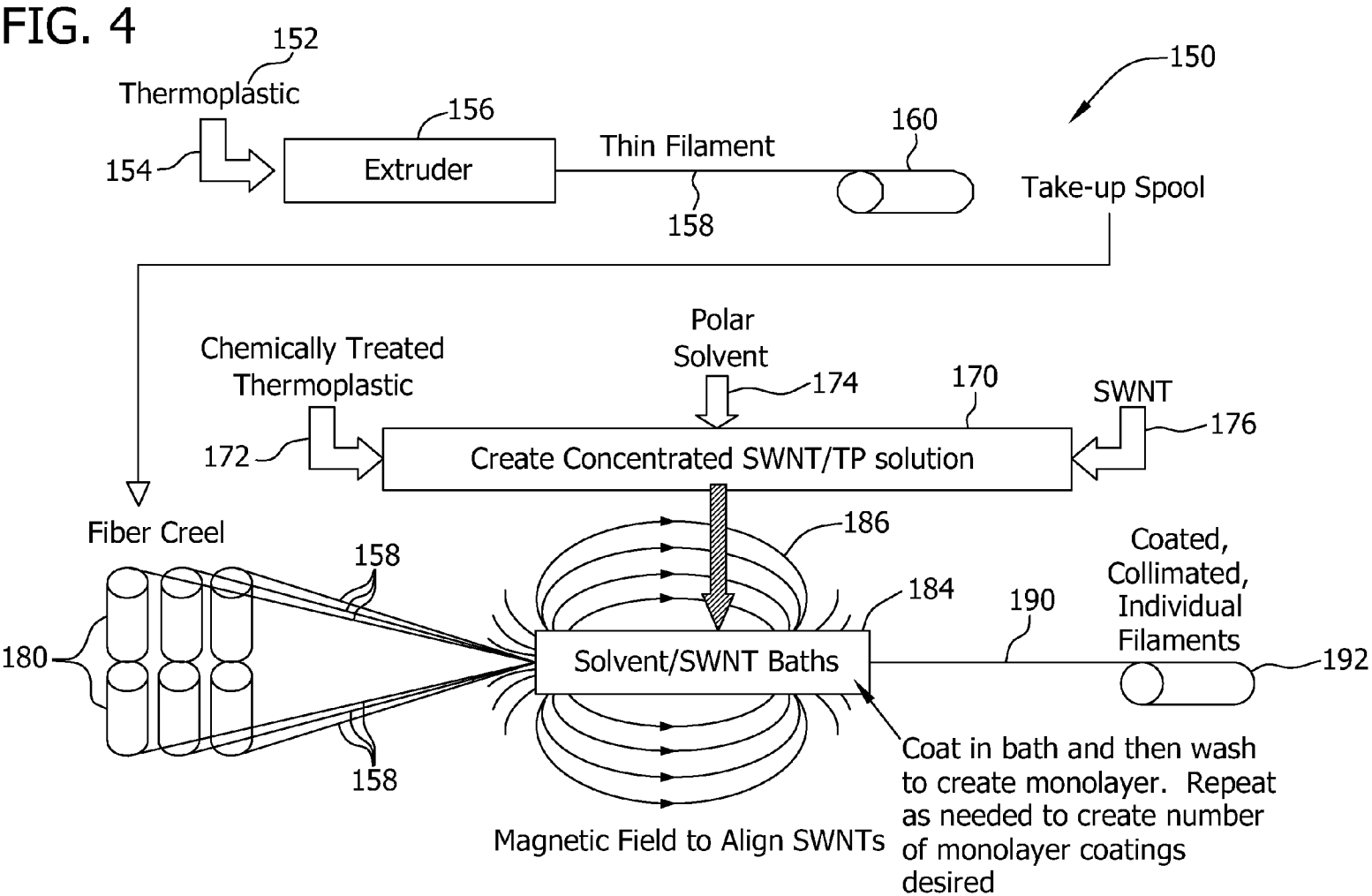
FIG. 4 is a block diagram that illustrates the individual components and processes utilized in fabricating a carbon nanotube-based conductor.

FIG. 4 is a block diagram 150 that illustrates the individual components utilized in fabricating a carbon nanotube-based conductor. As mentioned herein, coating methodologies are utilized to introduce sufficiently high concentrations of CNTs into polymeric materials for high-conductivity wire which are applied using layer-by-layer coating, as opposed to previously disclosed methods that disclose the mixing of CNTs into a resin. It is believed the currently disclosed solutions are preferable because no current solution exists for making CNT-based wires, though some methods have been proposed, as described above.

Now referring specifically to FIG. 4, fabrication of the thermoplastic filaments is described. A thermoplastic material 152 is input 154 into an extruder 156 configured to output a thin filament 158 of the thermoplastic material which is gathered, for example, onto a take up spool 160.

In a separate process, a concentrated solution 170 is created that includes, at least in one embodiment, thermoplastic material 172, a solvent 174, and carbon nanotubes (CNTs) 176. The solution 170, in at least one embodiment, is an appropriate solution of CNTs 176, solvent 174, and may include other materials such as surfactants suitable for adhering to the outer surface of thermoplastic filaments. In one embodiment, the solution 170 includes one or more chemicals that de-rope, or de-bundle, the nanotubes, thereby separating single-walled nanotubes from other nanotubes. The solution 170 is further suitable for coating thin, flexible filaments with multiple monolayers of CNTs, for example in a configuration as illustrated by FIG. 2, to achieve a desired concentration. In one embodiment, the solution 170 is a portion of the fabrication that is set up for continuous dipping, washing, and drying of individual CNT layers as they are applied to the filament.

Continuing, to fabricate the above described conductor, one or more separate creels 180 of individual thermoplastic filaments 158 are passed through a bath 184 of the above described solution 170. As the filaments 158 pass through the bath 184, a magnetic field 186 is applied to the solution 170 therein in order to align the carbon nanotubes 176. In a specific embodiment, which is illustrated, the CNTs 176 that are to be attached to the filaments 158 are the single-walled nanotubes.

The magnetic field 186 operates to provide, at least as close as possible, individual carbon nanotubes for layered attachment to the filaments 158. The magnetic field 186 operates to align CNTs along the principal direction of the filaments.

The embodiments represented in FIG. 4 all relate to a continuous line suitable for coating thin, flexible, polymeric strands (filaments 152) with a layer of the CNT solution 170 at a sufficient thickness to achieve a desired concentration or conductivity. The magnetic field 186, which may be the result of an electric field, is utilized to align the CNTs 176 in the solution 170 into the same direction as the processing represented in the Figure.

In one embodiment, the filaments 158 emerge from the solution 170 as coated strands 190 which are then washed and subsequently gathered onto spools 192 for post-processing. As shown in FIG. 4, the coated strands 190 may be subjected to a repeatable process. For example, to fabricate the multiple conductive layers as shown in FIG. 2, the filaments 158 are passed through the solution 170 and subsequently washed as many times as needed to create the number of monolayers of CNTs to create, for example, the desired conductivity. Finally, though not shown in FIG. 4, a suitable, flexible outer coating may be applied to the coated strands 190 and subsequently packaged in a fashion similar to that used for metallic wire.

Figure 5:
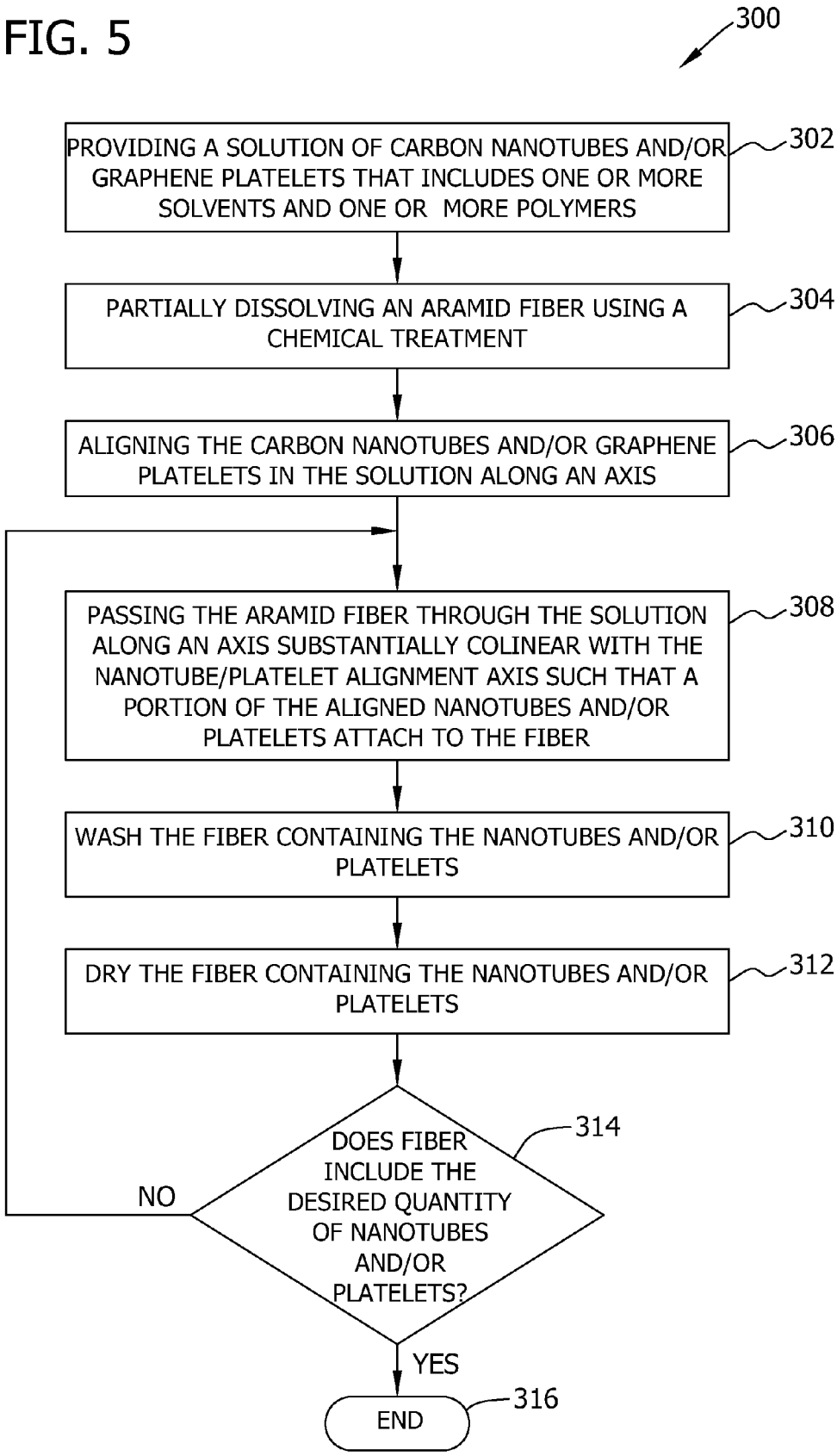
FIG. 5 is a flowchart illustrating conductor fabrication that incorporates carbon nanotubes and/or graphene platelets disposed in layers onto an aramid fiber.
Figure 6:
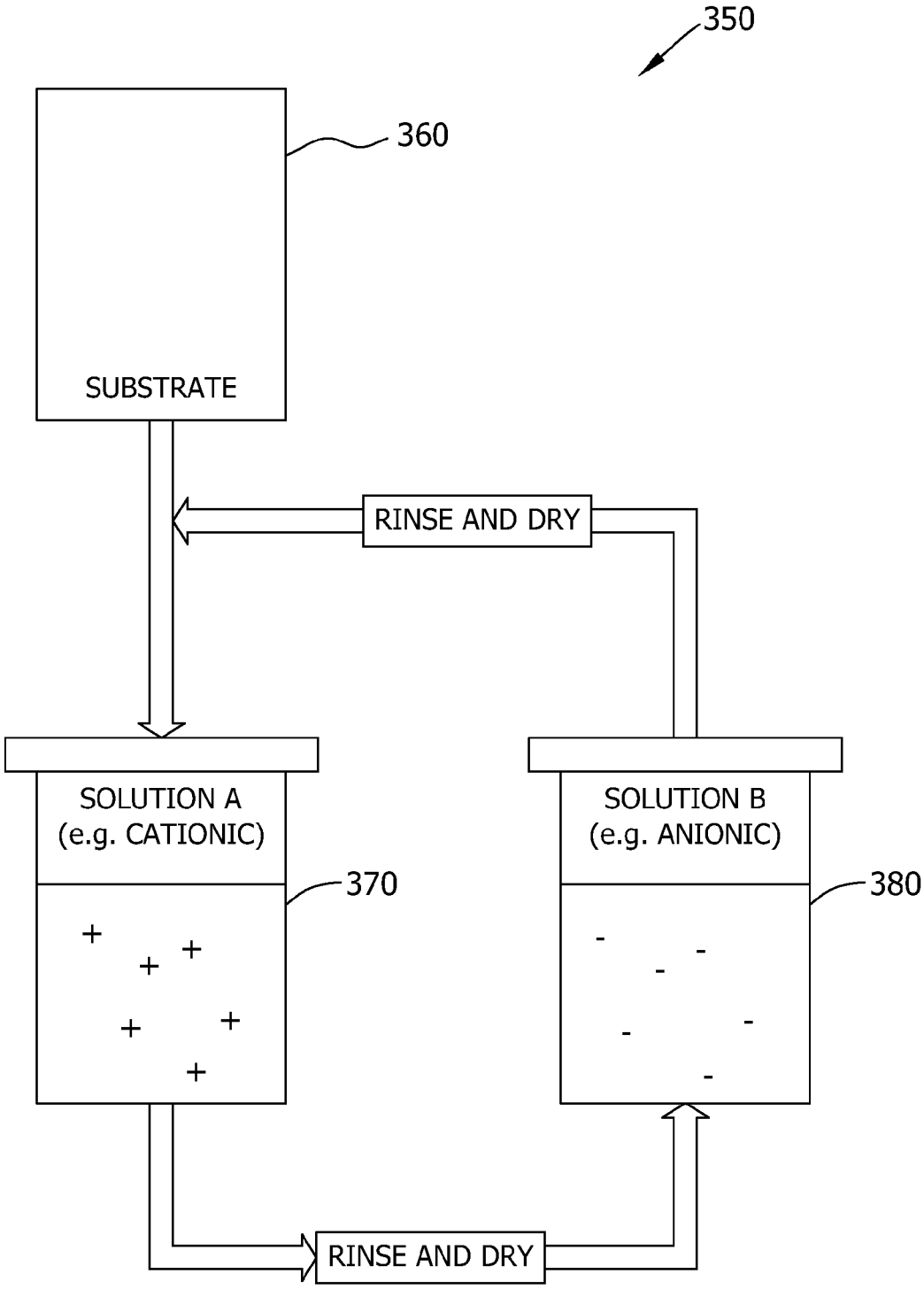
FIG. 6 is a flow diagram that further illustrating application of carbon nanotubes and/or graphene platelets onto a substrate.
Figure 7:
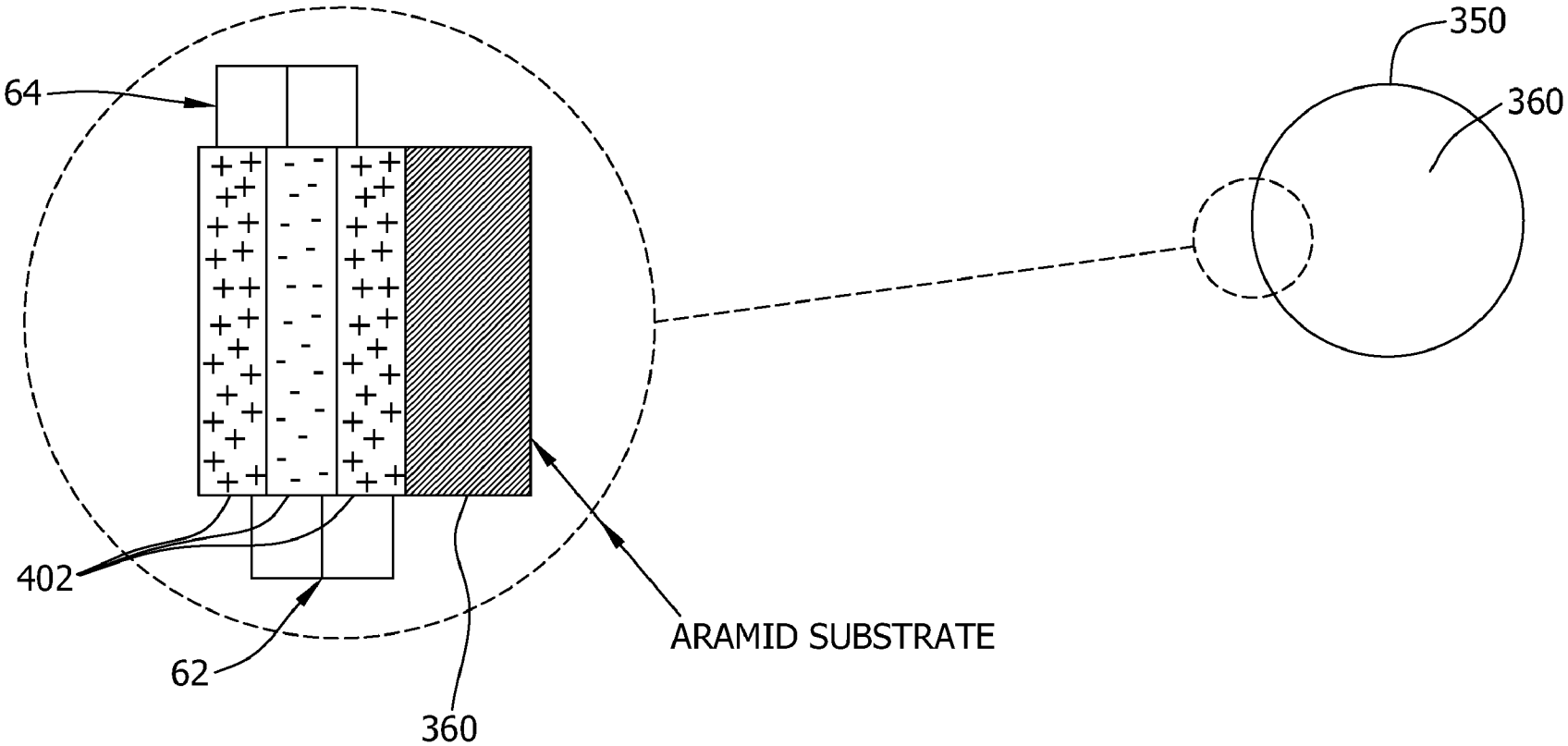
FIG. 7 is a cross-sectional diagram further illustrating a conductor fabricated utilizing the process of FIG. 5.

FIGS. 5, 6, and 7 are directed to embodiments that do not rely on having a thermoplastic carrier as described above. Instead, carbon nanotubes and/or graphene platelets are deposited in monolayers onto an aramid substrate. Specific embodiments utilize only high-conductivity, single-walled, metallic carbon nanotubes to maximize electrical performance and therefore rely on solutions that contain specific highly conductive carbon nanotubes and/or graphene platelets instead of mixtures of several types of carbon nanotubes. Mixtures of several types of carbon nanotubes may lead to a degradation of electrical performance or may be used to reach specific levels of electrical performance. In such embodiments, concentration levels of carbon nanotubes and/or graphene platelets are optimized for wire, not for films or sheets, and therefore high strength and high stiffness are not generally desirable.

In mentioned in the preceding paragraph, the process incorporates layer-by-layer coating, which includes the introduction of sufficiently high concentrations of carbon nanotubes and/or graphene platelets into a solution that includes polymeric materials for layer-by-layer fabrication of high-conductivity wire as opposed to the mixing of carbon nanotubes and/or platelets into a resin.

The embodiments described in the preceding paragraphs are further illustrated by the flowchart 300 of FIG. 5, which is an illustration of a method for producing high-conductivity electrical wires based on layer-by-layer coating. In the method, metallic carbon nanotubes (CNTs), and graphene platelets are utilized to provide sufficiently high concentrations of CNTs and/or platelets into polymeric materials and onto an aramid resulting in a high-conductivity conductor. The focus is on high conductivity combined with high flexibility for electrical conductors instead of a focus on high stiffness, high strength, or modest increases in conductivity as were the case in prior layer-by-layer applications.

Now referring to the flowchart 300, a solution of CNTs and/or graphene platelets are provided 302 in a solution that includes one or more solvents and one or more polymers. An aramid fiber is also provided, the fiber being partially dissolved 304 using, for example, a chemical treatment. The CNTs and/or graphene platelets are aligned 306 within the solution along an axis. Aligning the CNTs and/or platelets in the solution in the same direction as the fiber passes through the solution is accomplished, for example, using one or more of a magnetic field, an electric field or another alignment process.

The aramid fiber is then passed 308 through the solution along an axis that is substantially collinear with the nanotube/platelet alignment axis such that a portion of the aligned CNTs and/or graphene platelets attach to the partially dissolved aramid fiber. The fiber containing the aligned CNTs and/or graphene platelets is than rinsed 310 and dried 312. If the rinsed 310 and dried 312 fiber includes 314 the desired quantity of CNTs and/or graphene platelets, the process ends 316. Otherwise, the passing 308 through solution, rinsing 310, and drying 312 steps are repeated until the desired number of layers have been added to the aramid fiber or the desired quantity of CNTs and/or graphene platelets are attached to the fiber. After fabrication, an outer coating, such as wire insulation, may be applied to the layered assembly and the assembly gathered, for example, onto a take-up spool. Alternatively, the coated strands may be collected on to spools for post-processing into wire or the twisting of multiple strands into wire may be performed in line after the layer-by-layer processing. Other processing may include the twisting of multiple coated strands.

The process illustrated by the flowchart 300 allows for high volume fractions of aligned carbon nanotubes and/or graphene platelets to be applied to an aramid fiber to produce high-conductivity wires using layer-by-layer fabrication. Such a fabrication process avoids the necessity for having to mix nanoparticles and/or nanotubes into a matrix resin, as described above.

FIG. 6 is a flow diagram 350 that further illustrates application of layers of CNTs and/or graphene platelets onto a substrate 360, for example, a fiber formed using an aramid. This substrate 360 is passed through a first solution 370, rinsed and dried, then passed through a second solution 380 and again rinsed and dried. The process is repeated as necessary. In the illustrated embodiment, the first solution 370 that includes the CNTs and/or graphene platelets is a cationic solution and the second solution 380 including CNTs and/or graphene platelets is an anionic solution.

FIG. 7 includes a cross-sectional diagram further illustrating a conductor 400 fabricated utilizing the process of FIGS. 5 and 6. As shown in the cross section of conductor 400, the aramid fiber 360, or substrate, has a plurality of layers 402 attached thereto. The layers 402 are denoted to indicate which is associated with the cationic solution and which is associated with the anionic solution, though it is possible to have layers all generated from a single one of the solutions. These layers 402 include the CNTs and/or the graphene platelets therein. The layers 402 are placed around the circumference of fiber 360 and are attached thereto in part due to the dissolving process that makes the aramid amenable to the attachment of such nanoparticles. In one specific embodiment, the layers 402 that include the CNTs are processed to include only single-walled nanotubes. While fiber 360 is illustrated as being circular in cross-section, the embodiments described herein are operable with any cross-sectional configuration for this substrate.

The illustrated embodiment shown in FIG. 7 includes three CNT/graphene platelet layers 402 originating about substrate 360. It should be noted that the three-layer configuration is but one example of a conductor, and that fewer or additional alternating layers could be utilized depending on, for example, expense and desired conductivity. As mentioned elsewhere herein, the CNTs and/or graphene platelets are applied, for example, by passing the aramid fiber through a concentrated solution that includes, at least in one embodiment, thermoplastic material, a solvent, and carbon nanotubes and/or graphene platelets. In one embodiment, the solution is used as a portion of the fabrication and is set up for continuous dipping, washing, and drying of individual CNT/platelet layers as they are applied to the substrate.

In one embodiment, and as described above, the solution includes one or more chemicals that de-rope, or de-bundle, the nanotubes and/or platelets into as close to individual particles as possible, thereby separating individual nanotubes from other nanotubes. The de-bundled CNTs/platelets may be separated into different types, for example via centrifugation, and the metallic CNTs with "armchair" configuration (having the hexagonal crystalline carbon structure aligned along the length of the tube) are extracted as the CNTs configured in this fashion have the highest conductivity. Further processing allows for these "armchair"-configured CNTs to be predominately, or substantially exclusively in the fabrication of the conductor. Similarly, the highest-conductivity graphene platelets are isolated. These processes are generally done in separate operations from the layer-by-layer deposition described herein.

The described embodiments do not rely on dispersing CNTs into a resin as described by the prior art. Instead, layers of CNTs are placed about the circumference of small-diameter thermoplastic filaments or aramid fibers as described above. Specific embodiments utilize only high-conductivity, single-walled, metallic CNTs to maximize electrical performance. Such an embodiment relies on very pure solutions of specific CNTs instead of mixtures of several types to ensure improved electrical performance. The concentrations levels of CNTs to coating are optimized for conductivity, in all embodiments, as opposed to concentrations that might be utilized with, or dispersed on, films, sheets and other substrates.

This written description uses examples to disclose certain embodiments, including the best mode, and also to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A conductor comprising:

an aramid fiber; and at least one layer attached about said aramid fiber, said at least one layer comprising at least one of aligned carbon nanotubes and graphene platelets.

2. A conductor according to claim 1 wherein said aligned carbon nanotubes comprise a plurality of conductive nano-scale material elements having a hexagonal crystalline carbon structure aligned along the length of each said nano-scale material element.

3. A conductor according to claim 1 further comprising an outer coating substantially surrounding the plurality of conductive layers along an axial length thereof.

4. A conductor according to claim 1 wherein said plurality of carbon nanotubes comprise single-walled, metallic carbon nanotubes.

5. A conductor according to claim 1 wherein said aramid fiber comprises a chemically treated aramid fiber, the chemical treatment causing a partial dissolving of said fiber.

6. A conductor according to claim 1 wherein said at least one of aligned carbon nanotubes and graphene platelets are aligned in a solvent and polymer solution before the passing of said aramid fiber through the solution in a direction substantially collinear with the alignment.

7. A conductor according to claim 1 wherein said at least one layer is applied to said aramid fiber by passing said fiber through a solution that contains at least one of carbon nanotubes and graphene platelets.

8. A conductor according to claim 1 wherein said at least one of carbon nanotubes and graphene platelets are de-bundled into substantially individual particles.

9. A conductor according to claim 8 wherein the nanotubes are separated according to their crystalline carbon structure.

10. A method for fabricating a conductive wire comprising:

aligning at least one of carbon nanotubes and graphene platelets dispersed within a solution;

partially dissolving an aramid fiber through chemical treatment;

passing the treated aramid fiber through the solution such that a portion of the at least one of carbon nanotubes and graphene platelets aligned and dispersed within the solution adhere to the treated aramid fiber; and washing and drying the fiber.

11. A method according to claim 10 further comprising repeating the passing step and the washing and drying step to apply multiple layers of the at least one of carbon nanotubes and graphene platelets to the treated fiber.

12. A method according to claim 11 wherein passing the treated aramid fiber further comprises passing the treated aramid fiber through the solution in a direction substantially collinear with the direction of alignment of the at least one of carbon nanotubes and graphene platelets.

13. A method according to claim 10 further comprising separating the at least one of nanotubes and platelets such that those disbursed in the solution are predominately those that have a hexagonal crystalline carbon structure aligned along their length.

14. A method according to claim 10 wherein aligning at least one of carbon nanotubes and graphene platelets dispersed within a solution comprises aligning the at least one of carbon nanotubes and graphene platelets using at least one of an electric field and a magnetic field.

15. A method for fabricating a conductor comprising:

partially dissolving an aramid fiber through chemical treatment; and adhering at least one of aligned carbon nanotubes and aligned graphene platelets to the partially dissolved aramid fiber.

16. A method according to claim 15 wherein adhering at least one of aligned carbon nanotubes and aligned graphene platelets comprises:

aligning the at least one of carbon nanotubes and graphene platelets within a solution utilizing at least one of an electric field and a magnetic field; and passing the fiber through the solution along an axis of alignment such that the at least one of carbon nanotubes and graphene platelets adhere to the fiber.

17. A method according to claim 16 further comprising:

separating the carbon nanotubes according to their crystalline carbon structure; and causing at least one of those nanotubes and those platelets whose crystalline carbon structure is aligned along a length thereof to adhere to the fiber.

18. A method according to claim 15 wherein adhering at least one of aligned carbon nanotubes and aligned graphene platelets comprises adhering single-walled carbon nanotubes to the fiber.

19. A method according to claim 15 further comprising:

washing and drying the fiber after adhering at least one of carbon nanotubes and graphene platelets thereto; and repeating the adhering step and the washing and drying step until a desired number of layers or a desired quantity of the at least one of carbon nanotubes and graphene platelets is adhered to the aramid fiber.

* * * * *